United States Patent [19]

Sheu

[11] Patent Number: 4,738,190

[45] Date of Patent: Apr. 19, 1988

[54] FAN CASING WITH COVER

[76] Inventor: Muh-Chuan Sheu, No. 642, Chung-Cheng Road, I-Chia Village, Jen-Teh Hsiang, Tainan Hsien, Taiwan

[21] Appl. No.: 850,774

[22] Filed: Apr. 11, 1986

[51] Int. Cl.[4] ..... F24F 7/013

[52] U.S. Cl. ..... 98/116; 251/129.2; 98/42.09

[58] Field of Search ..... 98/116, 42.09, 42.12; 251/129.2, 298, 308

[56] References Cited

U.S. PATENT DOCUMENTS

| | | | |
|---|---|---|---|
| 957,776 | 5/1910 | Ilg | 98/116 X |
| 1,792,514 | 2/1931 | Spear | 98/116 X |
| 3,036,541 | 5/1962 | Musick et al. | 251/129.2 X |
| 3,484,075 | 12/1969 | Weekley | 251/298 X |
| 4,556,192 | 12/1985 | Ramisch | 251/308 X |

FOREIGN PATENT DOCUMENTS

| | | | |
|---|---|---|---|
| 54-113950 | 9/1979 | Japan | 98/116 |
| 235934 | 6/1925 | United Kingdom | 98/116 |

*Primary Examiner*—Harold Joyce

*Attorney, Agent, or Firm*—Finnegan, Henderson, Farabow, Garrett & Dunner

[57] ABSTRACT

A fan casing is provided with a cover plate which is mounted on a horizontal shaft above a casing opening for turning between a closed position and an opening position and which is actuated by a solenoid-operated rod provided in the casing.

3 Claims, 4 Drawing Sheets

FAN CASING WITH COVER

BACKGROUND OF THE INVENTION

This invention relates to a fan casing, and particularly to a casing for a wall fan having a cover for closing the opening of the casing and a solenoid-operated means to open the cover.

Typically, the casing of a wall fan includes a front opening and a rear opening provided with grilles for passage of the air when the fan operates. Such a wall fan is usually mounted in an opening in a wall of an enclosed space for ventilation. A drawback of the wall fan is that, when the operation of the fan is not needed, such as on rainy days or cold days, the fan casing becomes an undesirable passage in a wall through which undersirable things, such as insects, rats, and cold air can intrude into the enclosed space. Moreover, over a long period of time, exposure of the fan to rain water and bad weather results in reduced service life of the fan.

SUMMARY OF THE INVENTION

An object of the invention is to provide a fan casing with a cover so that the fan can be protected from rain and bad weather and the service life of the fan can be prolonged.

The present invention provides a fan casing: including a first wall with a first opening and a second wall opposing the first wall with a second opening; a cover plate attached pivotally to the first wall for covering the first opening and being turnable about an axis parallel to the first wall so as to move between an open position and a closed position; and a solenoid-operated means to actuate the cover plate.

In one aspect of the invention, the cover plate has at its top side a lug with an eye therein and is mounted fixedly on a horizontal shaft disposed above the first opening. The shaft passes through the eye of the lug and has a lobe extending radially therefrom. The cover plate is normally in a vertical plane to close the first opening and is turned 90 degrees upward to open the first opening. There is a helical spring sleeved around the shaft to bias the cover plate to abut against the first wall.

The solenoid-operated means includes a vertical rod having a hook end at its top side to engage with the lobe of the shaft and a solenoid means connected to the vertical rod to move it upward and downward.

The present preferred embodiment will be described in detail with reference to the following drawings.

DETAILED DESCRIPTION OF THE PREFERRED EMBODIMENT

Figure 1:
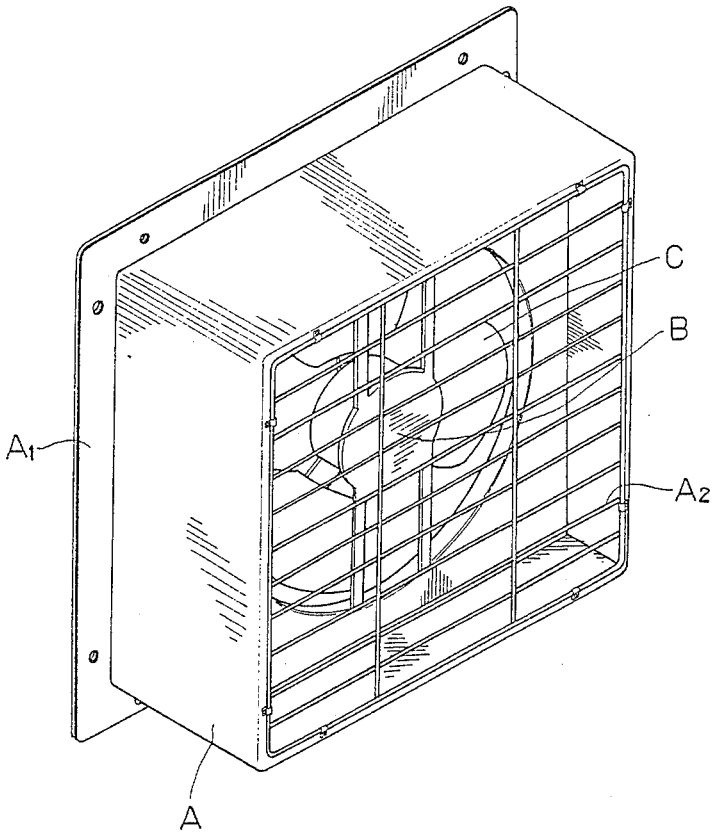
FIG. 1 PRIOR ART
FIG. 1 is a perspective view of a fan casing in the prior art.
Figure 2:
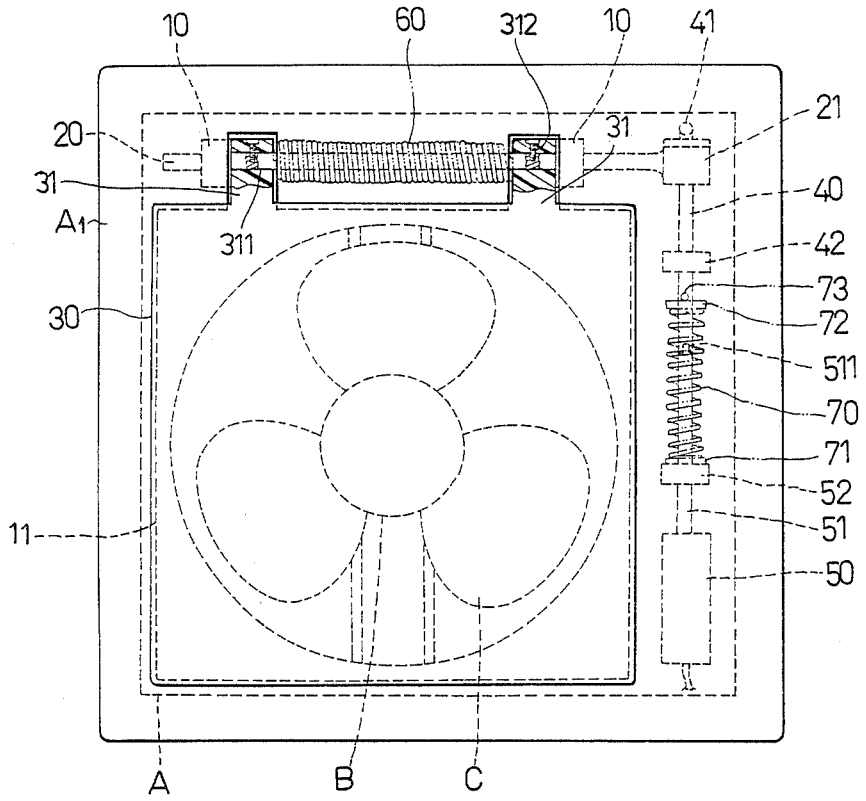
FIG. 2 is a front view of the fan casing of FIG. 1 incorporating a cover constructed according to the present invention.
Figure 3:
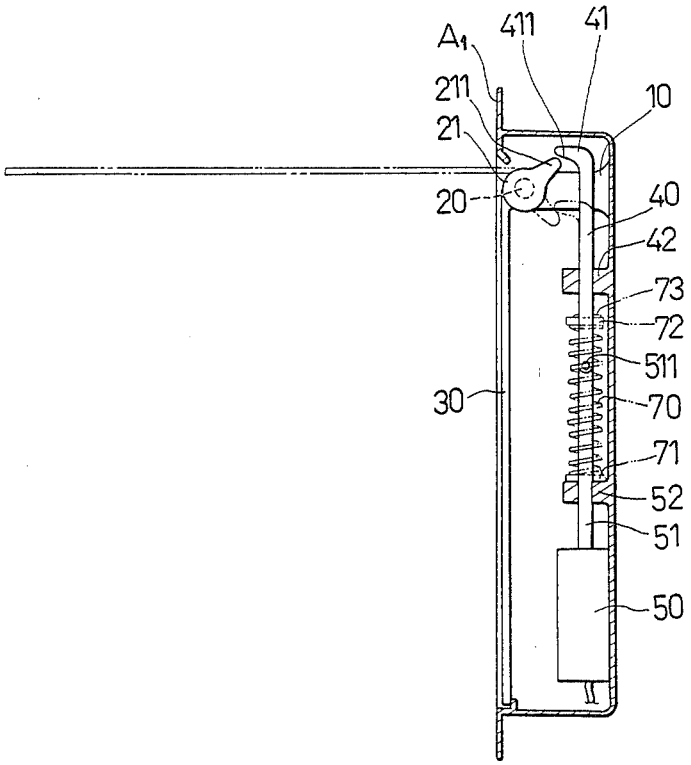
FIG. 3 is a side view of the fan casing of FIG. 2.

Referring to the drawings, there is shown a wall fan which includes a casing A having four side walls and opening at the front and the rear sides, a mounting flange A1 at the front side of the casing A, grille rods A2 disposed at the front and rear openings of the casing A. According to the present invention, a cover plate 30 is attached to the casing A to cover the front opening 11 of the casing A.

The cover plate 30 is a lightweight waterproof rectangular thin plate having two lugs 31 spaced apart at its top side. The lugs 31 are provided with eyes 311 through which a shaft 20 is inserted. The shaft 20 is journalled in two seats 10 which are formed at the rear side of the mounting plate A1. The lugs 31 are fixed to the shaft 20 by means of screws which are threaded into screw holes 312 of the lugs 31 so that the cover plate 30 can be turned together with the shaft 20.

One end of the shaft 20 extends almost to one side wall of the casing A and has at its end a cam-shaped body 21 which has a lobe 211 extending radially. Preferably, the lobe 211 extends in a direction at 45 degrees relative to a horizontal line.

There is a vertical rod 40 mounted movably on a bracket 42 projecting from the side wall of the casing, and it has a hook end 41 to engage with the lobe 211 of the cam-shaped body 21. The lower end of the rod 40 is connected to a rod 51 of a solenoid means 50 at point 511. The rod 51 of the solenoid 50 passes through a bracket 52 of the side wall of the casing A and a helical spring 70. One end of the spring 70 bears against a ring member 72 which engages with a transverse pin 73 fixed to the rod 40, and another end of the spring 70 bears against a ring member 71 which is disposed between the bracket 52 and the spring 70.

When the solenoid 50 is energized, the rod 40 is pulled downward. In this situation, the surface 411 of the hook end 41 of the rod 40 engages with the lobe 21 and depresses it, thereby turning the shaft 20 clockwise and turning the cover plate 30 90 degrees upward to open the front opening. When the solenoid means 50 is de-energized, the rod 40 moves upward by the action of the spring 70, disengaging from the lobe 211 of the cam-shaped body 21. Accordingly, the cover plate 30 will fall to its closed position due to its weight.

The solenoid means 50 can be arranged in such a manner that it is in series connection with the motor which operates the fan and is activated simultaneously with the motor by means of a switch. With such an arrangement, the cover plate 30 will open as soon as the motor operates. Alternatively, the solenoid means 50 can be in an arrangement in which it is activated independently of the motor.

There is a helical spring 60 sleeved on the shaft 20 between the lugs 31. The spring is arranged in such a manner that it biases the cover plate 30 to a position closing the casing tightly. Therefore, the cover will not rattle when it is struck by wind or rain. The force of the spring is chosen so that it is smaller than the force generated by the solenoid.

Figure 4:
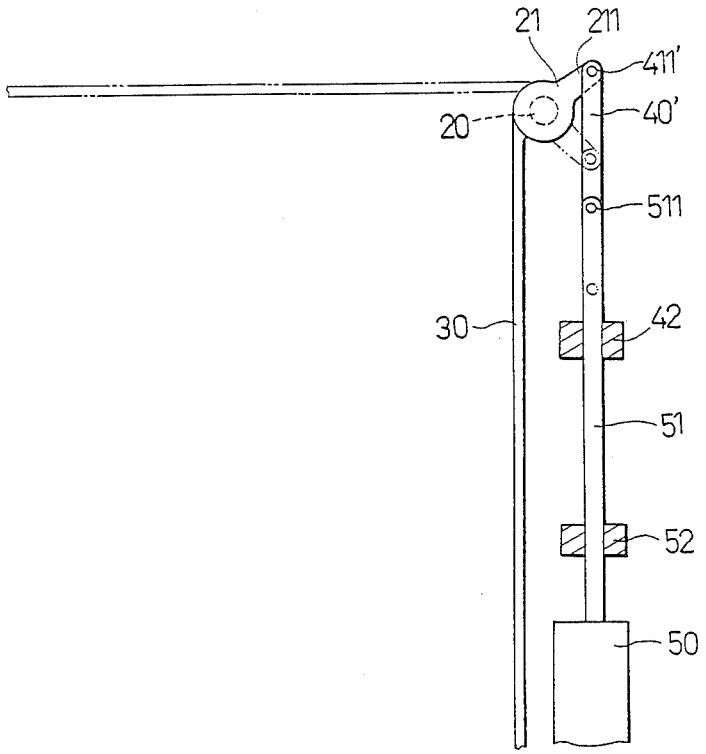
FIG. 4 is a schematic view showing an alternative arrangement of the shaft and the solenoid-operated means.

FIG. 4 shows an alternative arrangement for the the actuating means of the cover plate 30, wherein the arrangement of the rod 40' differs from the rod 40 in that the rod 40' has no hook end 411, but has an end 441' pivotally connected to the lobe 211 of the cam-shaped body 21. In operation, the rod 40' works in the same manner as the rod 40.

The cover constructed according to the present invention can be incorporated in a fan casing of any size, for example, a small fan used in a wall of a device incorporating a heater for dissipating heat wherein the cover of the fan can protect the device from intrusion of undesirable substances.

With the invention thus explained, it is apparent that the various modifications and variations can be made without departing from the scope of the invention.

I claim:

1. A fan casing comprising:

a housing having a first opening at one side thereof and a second opening at an opposite side thereof;

a horizontal shaft pivotally mounted on the housing above said first opening and parallel to the plane of said one side, said shaft having a lobe at one end extending radially therefrom;

a cover plate for covering said first opening, said cover plate having at its top side at least one lug with an eye therein through which said shaft passes and being fixedly mounted to the shaft so that as said shaft turns, said cover turns about the axis of said shaft between an open position and a closed position, a helical spring sleeved around said shaft to bias said cover plate to the closed position; and a vertical rod having a hook end at its top side in engagement with said lobe of said shaft and a solenoid means connected to said vertical rod to pull it downward upon activation of the means and pivot the cover plate to its open position.

2. The fan casing of claim 1, including a helical spring sleeved around the vertical rod to return the rod to its original position upon deactivation of the solenoid means.

3. The fan casing of claim 1, wherein the cover plate is normally in a vertical plane in its closed position and is turned through 90 degrees upward to its open position.

* * * * *